US005804750A

United States Patent [19]

Shirakawa et al.

[11] Patent Number: 5,804,750

[45] Date of Patent: Sep. 8, 1998

[54] UNIVERSAL MICROCOMPUTER CHIP FOR ELECTRONIC MUSICAL MACHINE

[75] Inventors: Tokio Shirakawa; Masaki Kudo; Shizuhiko Kawai, all of Hamamatsu, Japan

[73] Assignee: Yamaha Corporation, Japan

[21] Appl. No.: 763,720

[22] Filed: Dec. 13, 1996

[30] Foreign Application Priority Data

Dec. 28, 1995 [JP] Japan ..... 7-342447

[51] Int. Cl.[6] ..... G10H 7/00

[52] U.S. Cl. ..... 84/602; 84/604; 84/622; 84/659

[58] Field of Search ..... 84/601–602, 604–606, 84/609–610, 622–625, 659–660

[56] References Cited

U.S. PATENT DOCUMENTS 5,376,750 12/1994 Takeda et al. ..... 84/602
5,584,034 12/1996 Usami et al. ..... 395/800

FOREIGN PATENT DOCUMENTS 5-188952 7/1993 Japan .

*Primary Examiner*—Jonathan Wysocki
*Assistant Examiner*—Marlon T. Fletcher
*Attorney, Agent, or Firm*—Graham & James LLP

[57] ABSTRACT

A control circuit is integrated in a semiconductor chip for controlling operation of an electronic musical instrument according to a custom program stored in an external memory so as to generate a musical tone. In the control circuit, an internal memory is formed in the semiconductor chip separately from the external memory for permanently storing a common program which is dedicated to synthesis of the musical tone while the custom program stored in the external memory is customized for the operation of the electronic musical instrument. A tone synthesizer is formed in the same semiconductor chip for synthesizing -,he musical tone when the common program is executed. A central processor is formed in the same semiconductor chip integrally with the tone synthesizer and the internal memory for executing the custom program to control the operation of the electronic musical instrument and for executing the common program to effectuate the synthesis of the musical tone to generate the same sequentially in response to the operation of the electronic musical instrument.

7 Claims, 6 Drawing Sheets

1
2
EXTERNAL MEMORY
3
KEYBOARD/ PANEL
4
MIDI I/F
5
BUFFER
6
SOUND SYSTEM
11a
FIRST CPU
11b
RAM
11c
TIMER
11d
PARALLEL INPUT/OUTPUT PORT
11e
SERIAL INPUT/OUTPUT PORT
11f
MEMORY CONTROLLER
11g
12a
SECOND CPU
12b
RAM
12c
ROM
12d
TIMER
12e
13
BUS SELECTOR
14
TONE SYNTHESIZER
15
D/A CONVERTER

FIG.2A

| |
|---|
| AUTOMATIC PERFORMANCE PROGRAM |
| AUTOMATIC ACCOMPANIMENT PROGRAM |
| EXTERNAL COMMUNICATION PROGRAM |
| PANEL SCANNING PROGRAM |
| KEYBOARD SCANNING PROGRAM |
| ADDITIONAL PROGRAM |
| CPU COMMUNICATION PROGRAM |

FIG.2B

| |
|---|
| SOUND SOURCE CONTROL PROGRAM |
| TONE ASSIGNMENT PROGRAM |
| ADDITIONAL PROGRAM |
| CPU COMMUNICATION PROGRAM |

UNIVERSAL MICROCOMPUTER CHIP FOR ELECTRONIC MUSICAL MACHINE

BACKGROUND OF THE INVENTION

The present invention relates to a control system composed of a central processing unit (CPU) and a tone synthesizer, which are integrated in a single semiconductor chip to form a microcomputer used for controlling various machines or electronic apparatuses such as an electronic musical instrument, a karaoke machine, a game machine and a personal computer. Japanese Patent Laid-open No. Hei 5-188952 discloses a conventional control system composed of a CPU and a tone synthesizer integrated altogether in a semiconductor chip for controlling an electronic musical instrument or else. The conventional control system or circuit is formed in a semiconductor chip as a large scale integrated circuit (LSI) containing the CPU which is a core unit of the control system and the tone synthesizer which is a core unit of a sound source to generate a musical tone, as well as a scanning port for scanning a keyboard and a panel switch, a driving port for driving a display monitor and an access controller for accessing external ROM and RAM through an external memory bus. The CPU controls entire operation of the electronic musical instrument according to a program stored in the external ROM connected to the LSI. Specifically, the CPU controls scanning of the keyboard and the panel switch, Displaying of the monitor and processing of the tone generation. The sound source retrieves waveform data stored in the ROM to generate the musical tone under the control by the CPU. Such a control circuit is integrated into the semiconductor chip in the form of the LSI according to recent developments integration density of the semiconductor device. The use of the LSI can save a number of discrete components, can minimize a physical size of circuits and can improve reliability of electric connections.

The electronic musical instrument has a line of various models to meet a variety of user's needs. The electronic musical instrument has specific or unique performance according to difference in models. For example, a high grade model is equipped with automatic performance or automatic accompaniment. A low grade model may not require such a performance. Further, a number of the panel switches may vary among different models having a different number of preset tone colors. Moreover, a number of keys in the keyboard may vary among different models.

However, in the prior art using the conventional semiconductor chip, the program stored in the external ROM must be totally customized to realize a unique performance for each of various models in a wide lineup of products. This disadvantageously requires complicated and laborious design work of the program. Further, there may be a common part in the program among the different models of the program. However, in the prior art using the conventional semiconductor chip, the common part of the program must be written into the ROM for each different model. Otherwise, all kinds of performances and operations may be provisionally written into the program to form a common ROM which can be used for every model of the products. However, such a common ROM may contain redundant items of the program, which are not actually executed by the CPU particularly in the low grade model. Such a model cannot efficiently utilize a memory capacity of the precious ROM.

SUMMARY OF THE INVENTION

An object of the invention is to provide an improved control system composed of a CPU and a tone synthesizer integrated together in a semiconductor chip used to control an electronic apparatus, in which a ROM is readily customized to a variety of models by simplified rewriting of a program.

According to the invention, the control system is integrated in a semiconductor chip for controlling operation of an electronic apparatus according to a custom program stored in an external memory so as to generate a musical tone. The control system comprises an internal memory formed in the semiconductor chip separately from the external memory disposed outside the semiconductor chip, for permanently storing a common program which is dedicated to synthesis of the musical tone while the custom program stored in the external memory is customized for the operation of the electronic apparatus, a tone synthesizer formed in the same semiconductor chip for synthesizing the musical tone when the common program is executed, and a central processor formed in the same semiconductor chip integrally with the tone synthesizer and the internal memory for executing the custom program to control the operation of the electronic apparatus and for executing the common program to effectuate the synthesis of the musical tone to generate the same sequentially in response to the operation of the electronic apparatus.

In a specific form, the inventive control system is integrated in a semiconductor chip for controlling operation of an electronic apparatus according to a custom program stored in an external memory so as to generate a musical tone. The control system comprises a first microcomputer formed in the semiconductor chip, and including a first central processing unit and an interface so that the first central processing unit accesses the external memory through the interface to execute the custom program which is customized for controlling the operation of the electronic apparatus, a second microcomputer formed in the same semiconductor chip, and including a second central processing unit and an internal memory so that the second central processing unit executes a common program which is permanently stored in the internal memory and which is dedicated to synthesis of the musical tone, a tone synthesizer formed in the same semiconductor chip for synthesizing the musical tone when the common program is executed, and an internal bus for interconnecting altogether the first microprocessor, the second microprocessor and the tone synthesizer so that the musical tone is generated in response to the operation of the electronic apparatus.

The operation of the electronic apparatus exemplified by an electronic musical instrument is controlled by an operation program so as to a achieve basic performance and application performance. The operation program is classified into the custom program and the common program. The custom program is customized for a unique model of the electronic musical instrument to perform specific operations such as detection of manipulation of a keyboard and a panel switch, and play of automatic performance or automatic accompaniment. The common program is executed to control operation of the tone synthesis such as assignment of music events to channels of the tone synthesizer or sound source and settings of key codes and timbre codes to drive the sound source.

The custom program may vary among different models of the electronic musical instrument having different number of keys and panel switches. On the other hand, the common program can be commonly used for the tone synthesis among the different models. In view of this, the common program and relevant data are stored in the internal ROM which is integrated in the semiconductor chip together with the CPU. On the other hand, the custom program and associated data are stored in the external ROM so that the custom program can be readily rewritten to match with the specific model of the electronic musical instrument without need to rewrite the common program. Further, the custom program is readily designed a model by model basis since the design on work is done freely without consideration to the common program.

Further, in operation of the electronic musical instrument, the custom program is primarily executed at a preceding process to provide music events, and then the common program is secondarily executed at a succeeding process to treat the music events. In view of this, the first CPU carries out the preceding process according to the custom program stored in the external ROM, while the second CPU carries out the succeeding process according to the common program stored in the internal ROM. By such a manner, the first and second CPUs cooperate to each other in efficient manner to reduce respective work loads, while the pair of the first and second CPUs are commonly adapted to every model of the electronic musical instrument.

BRIEF DESCRIPTION OF THE DRAWINGS

FIGS. 2A and 2B show examples of programs stored in external and internal memories of the control circuit.

DETAILED DESCRIPTION OF THE INVENTION

Figure 1:
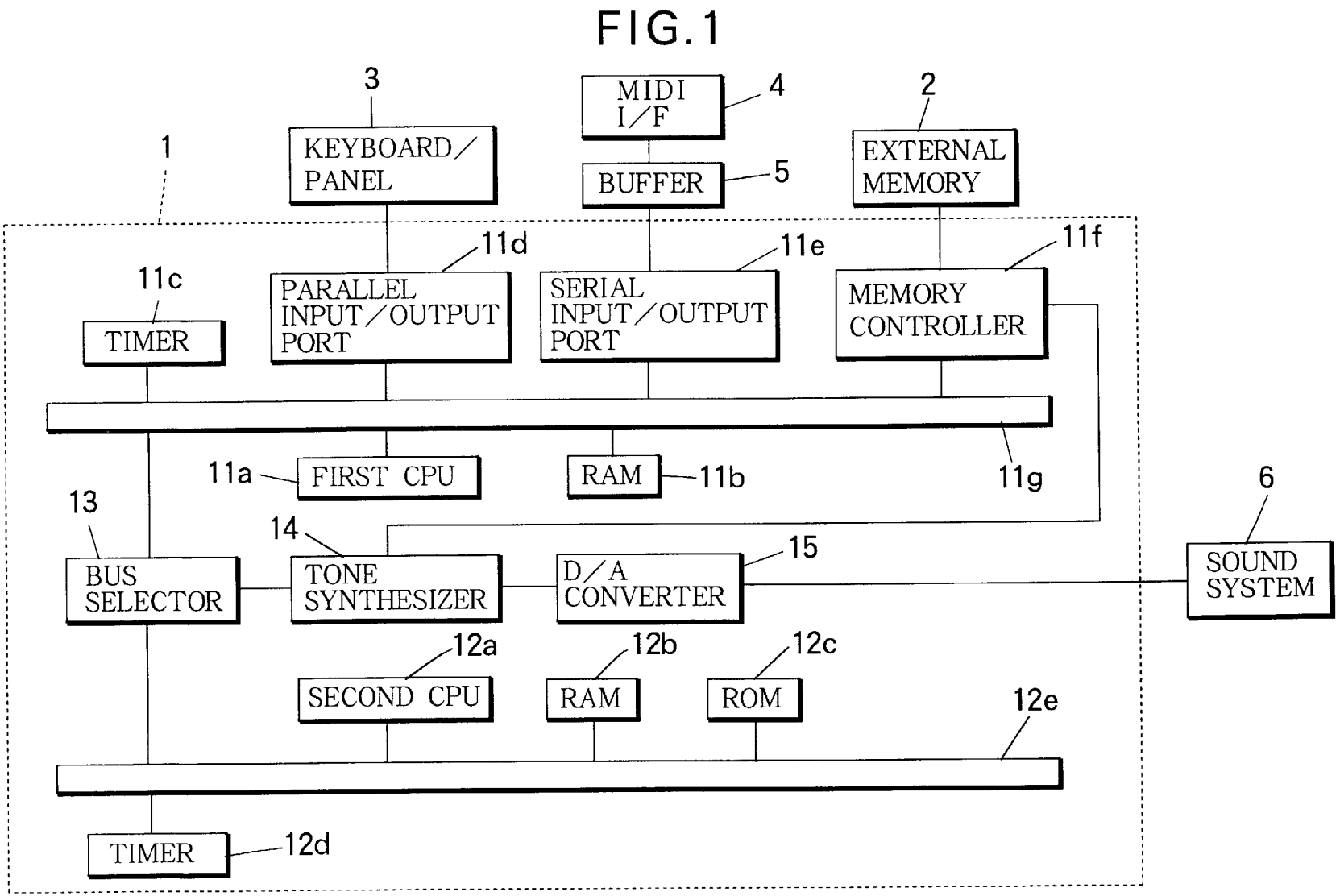
FIG. 1 is a block diagram showing one embodiment of the inventive control system or circuit used in an electronic musical instrument.

FIG. 1 shows an embodiment of the electronic musical instrument according to the invention. The electronic musical instrument includes a main control system or circuit 1 formed of a single semiconductor chip, an external memory 2 formed of a discrete read-only memory (ROM) for storing a custom program, and various peripheral devices such as a keyboard/panel 3, a MIDI interface 4, a data buffer 5 and a sound system 6. The electronic musical instrument is operated by a computer simply composed of a chip of the main control circuit 1, another chip of the external memory and additional chips of diodes and other components.

The control circuit 1 is divided into first and second microcomputers. The first microcomputer is comprised of a first CPU 11*a*, a RAM 11*b*, a timer 11*c* and several interfaces including a parallel input/output port 11*d*, a serial input/output port lie and a memory controller 11*f*. These units are interconnected to each other by a bus 11*g* to constitute the first microcomputer. The first CPU 11*a* operates according to the custom program stored in the external memory 2 while using the internal RAM 11*b* as a working area. On the other hand, a second CPU 12*a*, a RAM 12*b*, a ROM 12*c* and a timer 12*d* are interconnected to each other by another bus 12*e* to constitute the second microcomputer. The CPU 12*a* operates according to a common program permanently stored in the internal ROM 12*c* while using the internal RAM 12*b* as a working area.

A bus selector 13 interconnects the buses 11*g* and 12*e* to each other. A music tone synthesizer 14 is connected to the bus selector 13. The music tone synthesizer 14 is connected to the external sound system 6 through an internal digital/analog (D/A) converter 15.

The timer 11*c* of the first microprocessor is provided to determine scanning timings of key switches and panel switches contained in the keyboard/panel 3. Namely, the timer 11*c* periodically issues an interruption signal to the CPU 11*a*. The CPU 11*a* performs an interruption process in response to the interruption signal to scan the keyboard/panel 3 through the parallel input/output port 11*d* so as to detect music events such as a key event and a switch event. On the other hand, the serial input/output port 11*e* is used to serially receive and transmit a MIDI event.

The memory controller 11*f* is connected to those of the external memory 2 and the internal tone synthesizer 14. The memory controller 11*f* controls timings between a state where the CPU 11*a* accesses the external memory 2 to retrieve therefrom the custom program and another state where the tone synthesizer 14 accesses the external memory 2 to retrieve therefrom waveform data.

The first CPU 11*a* and the second CPU 12*a* communicate with each other through the bus selector 13 by handshake method or asynchronous acknowledgement method. Specifically, the bus selector 13 has therein one buffer memory. When the first CPU 11*a* writes data into a predetermined address of the buffer memory, the buffer selector 13 issues an interruption command to the second CPU 12*a* in response to the writing operation by the first CPU 11*a*. The CPU 12*a* responds to the interruption command to read out the data from the buffer memory. Then, the bus selector 13 issues another interruption command to the first CPU 11*a* in response to the reading operation of the second CPU 12*a*, so that the first CPU 11*a* acknowledges that the second CPU 12*a* has safely received the data.

By such a construction, the first CPU 11*a* operates according to the custom program stored in the external memory 2 so as to scan the keyboard/panel 3 to retrieve a key code and touch data in response to a key event, and to memorize a timbre code in response to a panel switch event and an address of corresponding waveform data in the RAM 11*b*. Further, the CPU 11*a* may control automatic play of instrument performance or accompaniment. Namely, the first CPU 11*a* executes the custom program customized to the operation of the electronic musical instrument, which is unique to the model thereof. Additionally, the first CPU 11*a* transfers music events containing the key code, the touch data, the timbre data and the address of the waveform data to the second CPU 12*a* so as to command synthesis and generation of the musical tone.

On the other hand, the second CPU 12*a* operates according to the common program stored in the internal ROM 12*c* to carry out channel assignment of the musical tone synthesizer 14 and settings of the data fed from the first CPU 11*a* in the channels of the tone synthesizer 14, thereby directly driving the musical tone synthesizer 14 or the sound source. Namely, the second CPU 12*a* executes the common program specialized for driving the sound source. In response to the tone generation command from the second CPU 12*a*, the tone synthesizer 14 retrieves the waveform data corresponding to the set timbre code and the key code from the external memory 2. Further, the synthesized tone is fed to the external sound system 6 through the D/A converter 15 to acoustically emit the synthesized musical tone in response to the operation of the keyboard/panel 3.

FIGS. 2A and 2B schematically show examples of the custom and common programs stored in the external memory 2 and the internal ROM 12*c*. As shown in FIG. 2A, the external memory 2 stores various items of the custom program in allotted addresses, including an automatic performance program for controlling automatic performance, an automatic accompaniment program for controlling automatic accompaniment, an external communication program for MIDI communication, a panel scanning program for scanning the panel switches of the keyboard/panel 3, a keyboard scanning program for scanning the key switches of the keyboard/panel 3, an additional program for carrying out additional processes and a CPU communication program for carrying out data communication with the second CPU 12*a*. The external memory 2 further stores the waveform data which is accessed by the musical tone synthesizer 14.

As shown in FIG. 2B, the internal ROM 12*c* stores various items of the common program in allotted addresses, including a sound source control program for driving the musical tone synthesizer 14, a tone assignment program for assigning the key events to tone generation channels of the musical tone synthesizer 14, an additional program for carrying out additional processes, and a CPU communication program for carrying out data communication with the first CPU 11*a*.

Figure 3:
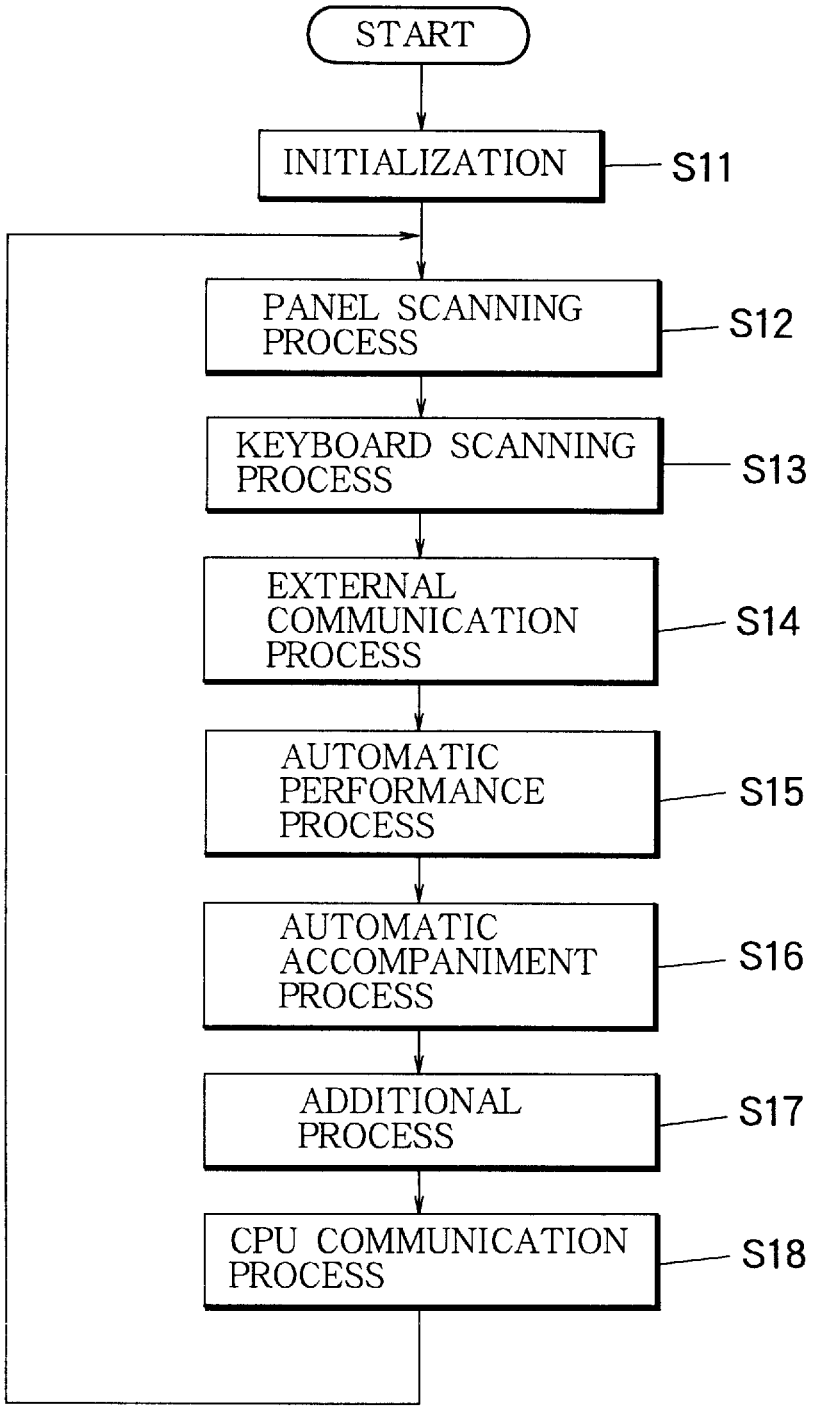
FIG. 3 is a flowchart showing operation of a first CPU in the control circuit.
Figure 4:
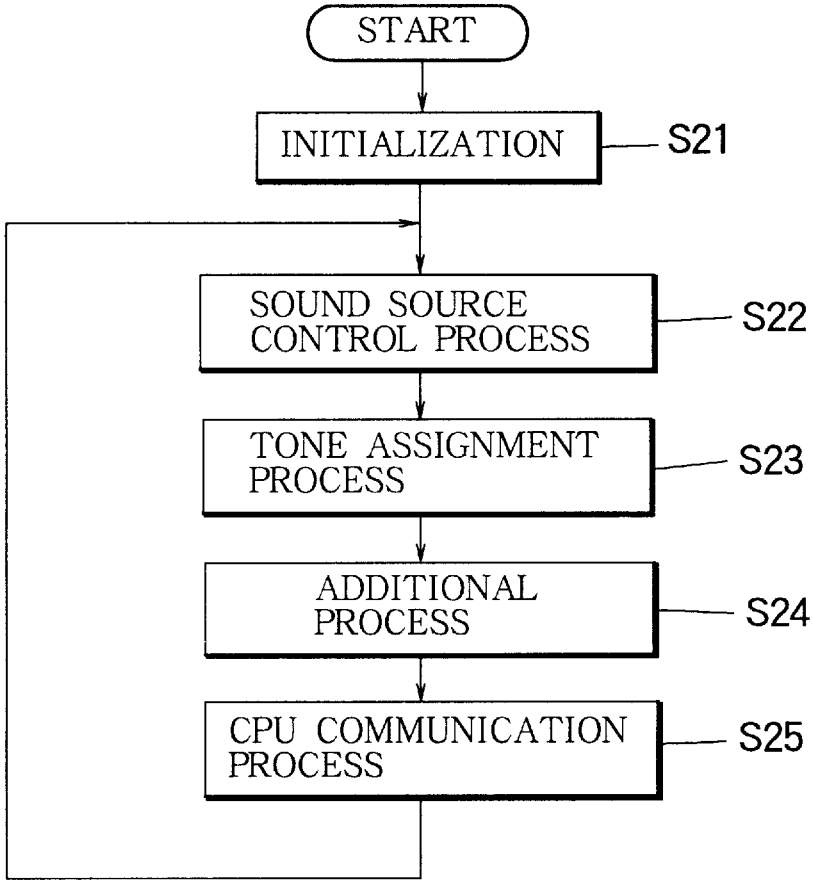
FIG. 4 is a flowchart showing operation of a second CPU in the control circuit.

FIG. 3 is a flowchart showing the process carried out by the first CPU 11*a*. First, initialization is carried out at a step S11. Then, the respective processes corresponding to the items of the custom program shown in FIG. 2A are sequentially carried out at steps S12–S18. Further, FIG. 4 is a flowchart showing the operation of the second CPU 12*a*. First, initialization is effected in a step S21. Thereafter, the CPU 12*a* sequentially carries out respective processes at steps S22–S25 which correspond to the items of the common program listed in FIG. 2B.

Figure 5:
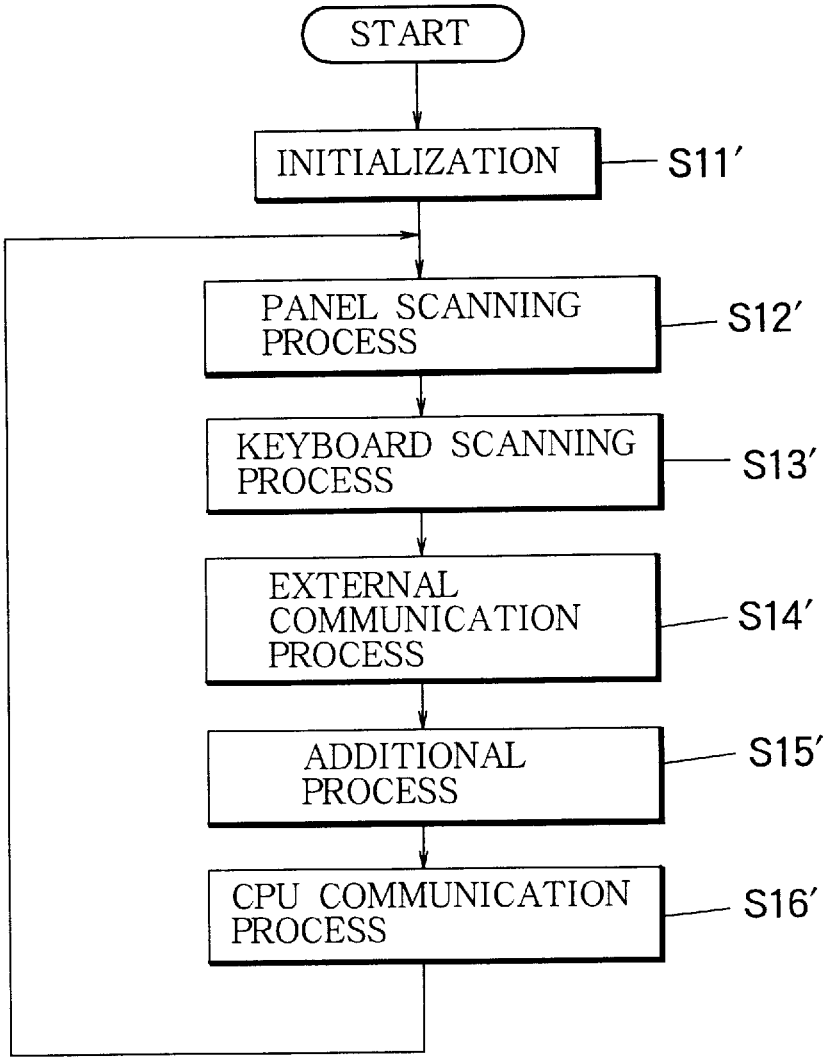
FIG. 5 is a flowchart showing operation of the first CPU in a variation of the inventive control circuit.

In the above described embodiment, the external memory 2 stores the custom program which is customized to include the automatic performance program and the automatic accompaniment program. The first CPU 11*a* executes the custom program to play the automatic music performance and the automatic instrumental accompaniment. However, the semiconductor chip having the same construction as the main control circuit 1 can be commonly used for the electronic musical instrument of another mode which does not have the function of the automatic performance and the automatic accompaniment. In such a case, the semiconductor chip is connected to an external memory which stores a custom program excluding the automatic performance program and the automatic accompaniment program. The CPU 11*a* executes such a custom program as shown in a flowchart of FIG. 5. In the flowchart of FIG. 5, steps S11'–S16' correspond to the step S11–S14, S17 and S18 of the FIG. 3 flowchart, while the steps S15 and S16 are eliminated. However, the second CPU 12*a* executes exactly the same processes as those shown in the flowchart of FIG. 4.

In variation, if the electronic musical instrument is designed for a variational model having a different number of panel switches and key switches, another external memory 2 is utilized which stores a modified panel scanning program and a modified keyboard scanning program.

As described above, the main control circuit 1 composed of the single semiconductor chip can be commonly used among different models of the electronic musical instrument, since the control circuit 1 carries out the common operation for the tone synthesizer 14. Further, the custom program can be designed freely without regard, to the common program which exclusively controls the music tone synthesizer 14, thereby facilitating design of the custom program. Moreover, in the disclosed embodiment, the first CPU 11*a* and the second CPU 12*a* cooperatively carry out a sequence of the tone generation processes such that the first CPU 11*a* carries out the primary or preceding process and the second CPU 12*a* carries out the secondary or succeeding process. The first and second CPUs communicate with each other to ensure the accurate control of the electronic musical instrument.

In the disclosed embodiment, the first CPU 11*a* exclusively executes the custom program stored in the external memory 2. However, in variation, an additional internal ROM may be provided in the semiconductor chip for use by the first CPU 11*a*, such that the additional ROM stores a part of the program which is commonly executed by the first CPU among different modes of the electronic musical instrument. Further, in the disclosed embodiment, the pair of the first CPU 11*a* and the second CPU 12*a* are integrated in the semiconductor chip. However, in variation, a single CPU having high performance may be used to execute both of the custom program stored in the external memory and the common program stored in the internal memory.

As described above, according to the invention, the control circuit 1 is integrated in the semiconductor chip for controlling operation of the electronic musical instrument according to the custom program stored in the external memory 2 so as to generate a musical tone. In the control circuit 1, the internal memory 12*c* is formed in the semiconductor chip separately from the external memory 2 disposed outside the semiconductor chip for permanently storing the common program which is dedicated to synthesis of the musical tone while the custom program stored in the external memory 2 is customized for the operation of the electronic musical instrument. The tone synthesizer 14 is formed in the same semiconductor chip for synthesizing the musical tone when the common program is executed. The central processor composed of the first CPU 11*a* and the second CPU 12*a* is formed in the same semiconductor chip integrally with the tone synthesizer 14 and the internal memory 12*c* for executing the custom program to control the operation of the electronic musical instrument and for executing the common program to effectuate the synthesis of the musical tone to generate the same sequentially in response to the operation of the electronic musical instrument. By such a manner, the external memory 2 alone is customized to a specific model of the electronic musical instrument, while the internal memory 12*c* is commonly used for every model of the electronic musical instrument.

In a specific form of the invention, the control circuit 1 is integrated in the semiconductor chip for controlling operation of the electronic musical instrument according to the custom program stored in the external memory 2 so as to generate a musical tone. In the control circuit, the first microcomputer is formed in the semiconductor chip, and includes the first central processing unit 11*a* and the interface in the form of the memory controller 11*f* so that the first central processing unit 11*a* accesses the external memory 2 through the memory controller 11*f* to execute the custom program which is customized for controlling the operation of the electronic musical instrument. The second microcomputer is formed in the same semiconductor chip, and includes the second central processing unit 12*a* and the internal memory 12*c* so that the second central processing unit 12*a* executes the common program which is permanently stored in the internal memory 12*c* and which is dedicated to synthesis of the musical tone. The tone synthesizer 14 is formed in the same semiconductor chip for synthesizing the musical tone when the common program is executed. The internal bus 11*g*, 12*e* is provided for interconnecting altogether the first microcomputer, the second microcomputer and the tone synthesizer 14 so that the musical tone is generated in response to the operation of the electronic musical instrument. By such a manner, the semiconductor chip is commonly used for every model of the electronic musical instrument.

Figure 6:
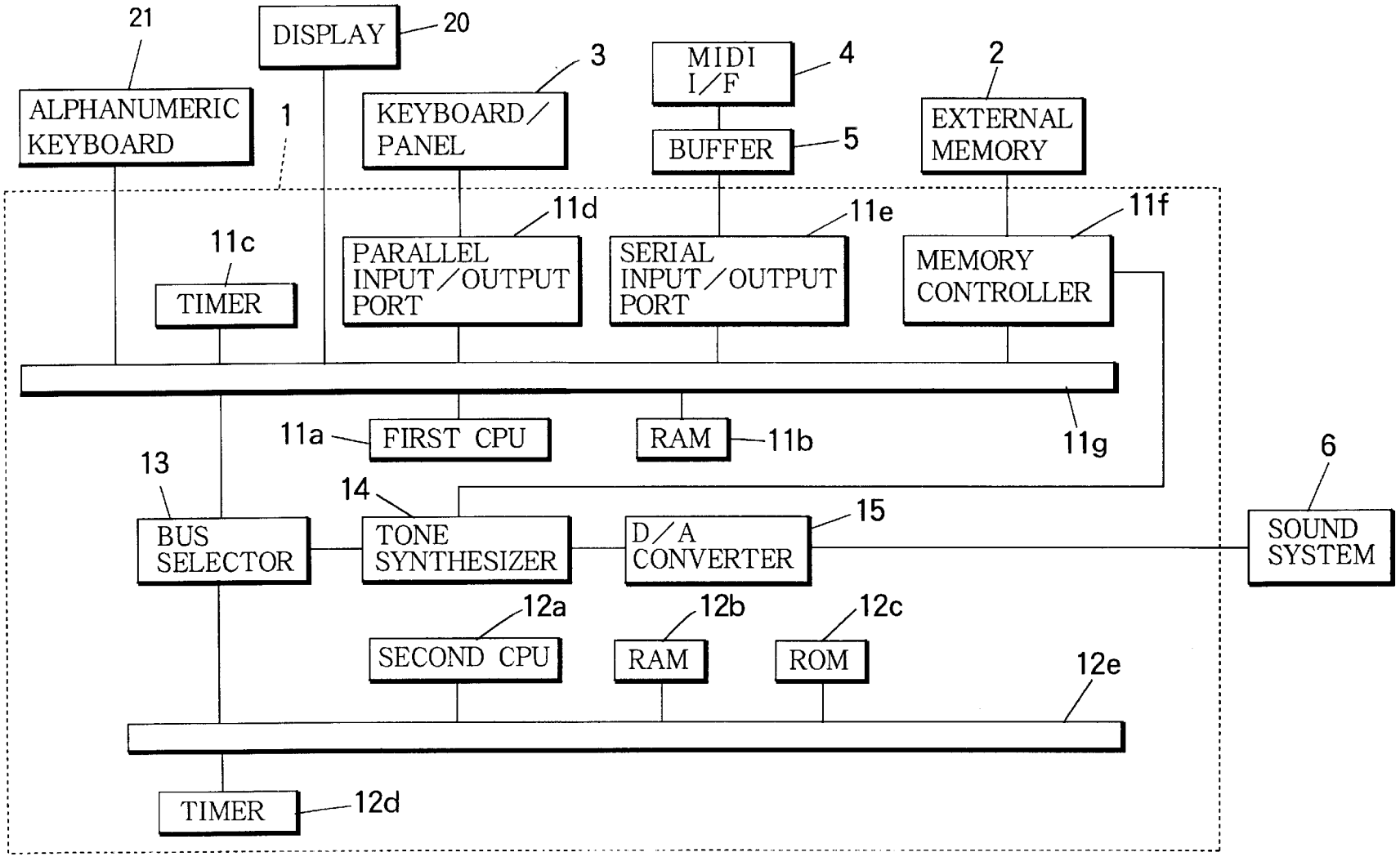
FIG. 6 is a block diagram showing another embodiment of the inventive control circuit applied to a personal computer.

FIG. 6 shows another embodiment of the invention where the control circuit 1 is applied to a personal computer. The personal computer is equipped with a display 20 as a typical visual output device and an alphanumeric keyboard 21 as a typical input device. The external memory 2 may be composed of RAM, ROM, hard disk (HD) or CD-ROM. The blocks 11*a*, 11*b*, 11*c*, 11*d*, 11*e*, 11*f*, 11*g*, 20 and 21 constitute a basic structure of the personal computer. The blocks 3, 4, and 5 are added to specialize the general personal computer as an electronic musical machine. The blocks 12*a*, 12*b*, 12*c*, 12*d*, 12*e*, 13, 14 and 15 constitute a sound source installed in the personal computer.

The external memory 2 stores an operating system program and a desired custom program or application program. The CPU 11*a* executes the application program so as to create a musical event. The musical event is fed to the sound source composed of the blocks 12*a*–12*d*, 13, 14 and 15 to generate a musical tone.

Further, the inventive control circuit 1 can be applied to various kinds of electronic machines such as a game computer and a karaoke machine in manner similar to the personal computer.

What is claimed is:

1. A control system integrated in a semiconductor chip for controlling operation of an electronic apparatus according to a custom program stored in an external memory so as to generate a musical tone, the control system comprising:

an internal memory formed in the semiconductor chip separately from the external memory disposed outside the semiconductor chip for permanently storing a common program which is dedicated to synthesis of the musical tone while the custom program stored in the external memory is customized for the operation of the electronic apparatus;

a tone synthesizer formed in the same semiconductor chip for synthesizing the musical tone when the common program is executed; and a central processor formed in the same semiconductor chip integrally with the tone synthesizer and the internal memory for executing the custom program to control the operation of the electronic apparatus and for executing the common program to effectuate the synthesis of the musical tone sequentially in response to the operation of the electronic apparatus.

2. A control system according to claim 1, wherein the internal memory comprises a read-only memory.

3. A control system according to claim 1, wherein the central processor comprises a first central processing unit for primarily executing the custom program, and a second central processing unit communicable with the first central processing unit for secondarily executing the common program.

4. A control system integrated in a semiconductor chip for controlling operation of an electronic apparatus according to a custom program stored in an external memory so as to generate a musical tone, the control system comprising:

a first microcomputer formed in the semiconductor chip, and including a first central processing unit and an interface so that the first central processing unit accesses the external memory through the interface to execute the custom program which is customized for controlling the operation of the electronic apparatus;

a second microcomputer formed in the same semiconductor chip, and including a second central processing unit and an internal memory so that the second central processing unit executes a common program which is permanently stored in the internal memory and which is dedicated to synthesis of the musical tone;

a tone synthesizer formed in the same semiconductor chip for synthesizing the musical tone when the common program is executed; and an internal bus for interconnecting altogether the first microcomputer, the second microcomputer and the tone synthesizer so that the musical tone is generated in response to the operation of the electronic apparatus.

5. An electronic musical apparatus comprising:

peripheral devices operable for inputting a music event and outputting a musical tone;

an external memory for storing a custom program which is customized to control operation of the peripheral devices; and a control circuit integrated in a semiconductor chip, and including an internal memory formed in the semiconductor chip separately from the external memory disposed outside the semiconductor chip for permanently storing a common program which is dedicated to synthesis of the musical tone, a tone synthesizer formed in the same semiconductor chip for synthesizing the musical tone according to the inputted music event, and a central processor formed in the same semiconductor chip integrally with the tone synthesizer and the internal memory for executing the custom program to control the operation of the peripheral devices and for executing the common program to effectuate the synthesis of the musical tone in response to the operation of the peripheral devices.

6. An electronic musical apparatus according to claim 5, wherein the peripheral devices include a keyboard for inputting the music event, and wherein the external memory stores the custom program customized to control the operation of the keyboard.

7. An electronic musical apparatus according to claim 6, wherein the external memory stores the custom program which is customized to control automatic operation of the peripheral devices to achieve either of an automatic accompaniment and an automatic performance.

* * * * *